US009504928B2

(12) United States Patent
Fingerer et al.

(10) Patent No.: US 9,504,928 B2
(45) Date of Patent: Nov. 29, 2016

(54) DEVICES AND METHODS FOR ENGAGING CHILDREN

(75) Inventors: Clarissa Fingerer, Brooklyn, NY (US); Moses E. Fingerer, Brooklyn, NY (US); Isaac C. Fingerer, Brooklyn, NY (US)

(73) Assignee: EXCITING UNLIMITED LLC, Brooklyn, NY (US)

( * ) Notice: Subject to any disclaimer, the term of this patent is extended or adjusted under 35 U.S.C. 154(b) by 1089 days.

(21) Appl. No.: 12/644,389

(22) Filed: Dec. 22, 2009

(65) Prior Publication Data

US 2011/0014847 A1 Jan. 20, 2011

Related U.S. Application Data

(60) Provisional application No. 61/225,614, filed on Jul. 15, 2009.

(51) Int. Cl.
*A63H 33/00* (2006.01)

(52) U.S. Cl.
CPC ..... *A63H 33/008* (2013.01); *A63H 33/006* (2013.01)

(58) Field of Classification Search
CPC ..... A63H 33/00
USPC ..... 446/227
See application file for complete search history.

(56) References Cited

U.S. PATENT DOCUMENTS

| | | | | |
|---|---|---|---|---|
| 5,881,391 | A * | 3/1999 | Mullaney | 2/209.13 |
| 5,903,927 | A * | 5/1999 | Wolfe et al. | 2/209.13 |
| 7,137,152 | B2 * | 11/2006 | Smith | 2/209.13 |
| 8,189,844 | B2 * | 5/2012 | Dolberg | 381/376 |

* cited by examiner

*Primary Examiner* — Michael Dennis
(74) *Attorney, Agent, or Firm* — Hunton & Williams LLP

(57) ABSTRACT

A system and method for providing a child activity device is disclosed. The system may comprise a child activity device. The child activity device may comprise a main portion; one or more playthings for engaging children; and one or more attachment mechanisms to couple the one or more playthings with the main portion. In some embodiments, the main portion may be a headpiece comprising at least one of a hat, a cap, a visor, a headband, or a bonnet. In other embodiments, the main portion may be a garment comprising at least one of an apron, a shirt, a jacket, a vest, or a belt. In yet other embodiments, the main portion may be a stand-alone structure comprising at least one of a tent, a blanket, a pillow, a wallpiece, a stroller, a stroller attachment, a crib, a crib attachment, a carseat, or a carseat attachment.

5 Claims, 4 Drawing Sheets

DEVICES AND METHODS FOR ENGAGING CHILDREN

CROSS-REFERENCE TO RELATED APPLICATIONS

This application claims priority to U.S. Provisional Application No. 61/225,614, entitled "Child Activity Device," filed on Jul. 15, 2009, which is hereby incorporated by reference in its entirety.

FIELD OF THE DISCLOSURE

The present invention relates generally to a child activity device and method, and more specifically, to a device and method for engaging and placating children.

BACKGROUND INFORMATION

Young children have a need to feel safe, comfortable, and familiar with their surroundings. They are curious about the world around them and therefore enjoy having many playthings close by. However, young children are also very sensitive to even the slightest change in their environment. For example, when a parent, guardian, or caretaker changes a child's diaper, puts a child to bed, feeds a child, or attempts to train a child how to use his or her potty, these experiences may be highly objectionable to the young child. The child may cry, yell, or throw a fuss simply because the child is no longer in an area where he or she is comfortable or familiar and cannot engage with various playthings since most playthings are not suitable for all environments. As a result, it may be important to provide devices and methods for engaging, distracting, or placating children, particularly in situations in which children typically find objectionable.

BRIEF DESCRIPTION OF THE DRAWINGS

In order to facilitate a fuller understanding of the exemplary embodiments, drawings have been appended. These drawings should not be construed as limiting, but are intended to be exemplary only.

DETAILED DESCRIPTION OF EMBODIMENTS

Reference will now be made in detail to exemplary embodiments, examples of which are illustrated in the accompanying drawings. It should be appreciated that the same reference numbers will be used throughout the drawings to refer to the same or like parts. It should be appreciated that the following detailed description are exemplary and explanatory only and are not restrictive.

Various exemplary embodiments may be directed to devices and methods for engaging and placating children. That is, exemplary embodiments, may among other things, engage and placate, as well as educate, young children by providing one or more child activity devices or methods during situations and experiences which a child may deem as objectionable.

Exemplary embodiments of the invention may provide devices and methods for providing a child activity device having one or more playthings attached. The child activity device may be provided so that it is within the child's field of vision. In addition, the child activity device may also be accessible to the child, e.g., by reach, touch, or other senses. As a result, even while the child is in a new or objectionable environment, the child may view, reach, interact with, or be engaged with the one or more playthings. By providing the child activity device in this manner, the child may be less likely to throw a fit in an otherwise objectionable environment.

It should be appreciated that the term, "objectionable," as used herein, may refer to any situation or experience in which a child does not feel comfortable. For example, these may include, but are not limited to, a diaper change, meal time, bath time, bed time, or sitting on a potty, etc. It should be appreciated that other various experiences, situations, settings, routines, and devices may also be deemed as objectionable.

Figure 1:
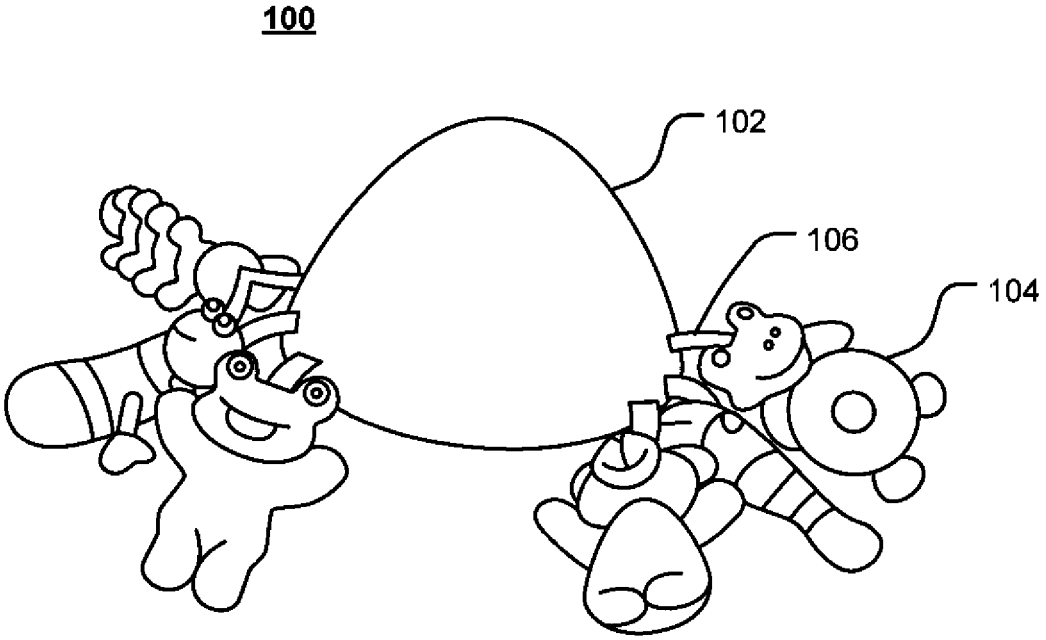
FIG. 1 depicts an illustrative child activity device, according to an exemplary embodiment.

FIG. 1 depicts an illustrative child activity device 100, according to an exemplary embodiment. The child activity device 100 may include main portion 102 and one or more playthings 104. The one or more playthings 104 may be attachable or detachable to the main portion 102 using one or more attachment mechanisms 106.

In some embodiments, the main portion 102 may be a headpiece that may be worn on a head of a child or a caregiver. For example, the main portion may be a hat, a cap, a visor, a headband, a bonnet, or other type of headpiece. In other embodiments, the main portion 102 may be worn on other parts of the body, such as the shoulder, knee, upper arm, or other part of a person's body. It should also be appreciated that the main portion 102 may also be attached to other objects, such as a dresser, wall, door, window, crib, or larger toy.

The main portion 102 may be adjustable so that the main portion 102 may fit on objects of various sizes (e.g., heads of different people). Accordingly, the main portion 102 may be fitted, adjustable, or "one-size-fits-all" size. The main portion 102 may also have one or more securement mechanisms to provide greater security of the child activity device 100 to an object to which it is attached. These may include laces, straps, Velcro, buttons, zippers, or other securement mechanisms.

In one example, the child activity device 100 may be worn on a caregiver's head and may be particularly suited to experiences where the caregiver's head or upper body is above the child, such as when the caregiver is changing the child's diaper, feeding the child (e.g., bottle feeding, etc.), calming the child and/or putting the child to bed. In this way, even during a possible objectionable experience, a child may engage with the one or more playthings 104 of the child activity device 100.

The one or more playthings 104 may include any object that is safe and may be interesting to a child. These may include, but are not limited to, stuffed animals, plastic chew toys, child-safe mirrors, rattles and/or bells. The one or more playthings 104 may be removable, partially or fully attached, secured, or otherwise connected to the main portion 102.

In some embodiments, the one or more playthings 104 may be flying objects that circle around the main portion 102 or other portion of the child activity device 100 (e.g., via a string or other similar attachment). It should be appreciated that the flying objects may also be motorized so that attachment to the main portion 102 is not required. For example, the one or more plaything 104 may be a miniature helicopter that, when detached from the landing pad on the main portion 102, it may fly independently in the air. The flying object may later be reattached.

In some embodiments, the one or more playthings 104 may also include electronic mechanisms that play music, show colorful lights, show video, move automatically and/or perform other activities. For example, an electronic lighting mechanism may be provided where to provide soothing illumination type of light that would placate and sooth a child while sleeping. In this example, the electronic light mechanism may be an adjustable, hands-free, portable light that may have a switch or other activating/deactivating mechanism. In another example, while a child is playing with the light and moves it around, the light may come on. After the child stops playing with the light, it may shut off after a predetermined amount of time. This predetermined amount of time may be customizable. In some embodiments, the electronic mechanism may need to be turned on constantly, e.g., to help a child sleep, etc. In yet another example, an electronic audio mechanism may be provided to emit a soothing sound to placate a child and help him or her sleep through the entire night. Other various electronic mechanisms or embodiments may also be provided, such as mobiles and other baby distraction devices.

Other features may also be incorporated to the electronic mechanism. These may include covers, shields, filters, child locks, heat dissipaters, switches, dimmers, accelerometers, bulbs, speakers, and/or other components. For example, in some embodiments, an electronic mechanism (e.g., a light) may be provided where the electronic mechanism may be constantly in the "on" position unless turned off or covered by a shield or other similar mechanism by a child or caregiver. It should be appreciated that these components may be selected to be used in the electronic mechanism based on safety, efficiency, weight, etc. For example, in an electronic light mechanism designed for being on through the night, a high-efficiency bulb or a rechargeable glowing photo-luminescent film may be used, as well as a rechargeable power source.

In some embodiments, the electronic mechanism may include a robot-like device. For example, a robotic doll may be provided where the robotic doll may be controlled (e.g., by voice-activation, switch, or other activation). For instance, when someone announces "meal time," the robotic doll may automatically produce and hand over a spoon to feed the child. In this example, the spoon may be folded up inside the doll, concealed with fabric in the arm, or obtained/concealed in one or more other ways. In another example, when someone announces "medicine time," another robotic doll may automatically produce a medicine-administration tool (e.g., a child-safe syringe) which may be used to administer the medicine to the child. In the event a child-safe syringe is used, the syringe may be part of the robotic doll's arm and may have a detachable component (e.g., tip or cap) to ensure sterility. In yet another example, when "diaper time" is announced, a robotic doll may automatically spray a perfume scent into the air or produce a diaper and/or baby wipe. In yet another example, when "sleeping time" is announced, a robotic doll may automatically sing a lullaby, tell a story, or perform one or more other sleep-inducing actions. In yet another embodiments, a robotic doll may serve as a surrogate caregiver, e.g., a "favorite" aunt or uncle," and electronically distract, calms, and/or coerce a toddler by saying, "If you're good, I have a surprise for you," and then dispense an award or prize (e.g., a jelly-bean, a sticker, etc.) to the child as incentive for a positive response, such as taking medicine, going to sleep, using the potty, and/or stopping tantrum-throwing. It should be appreciated that the voice of the surrogate caregiver may be pre-recorded. Other various embodiments may also be provided.

In some embodiments, the electronic mechanism may include a display screen, audio player, or other interactive multimedia device. Such an electronic mechanism may be large or small and may provide another way to teach, educate, interact, or otherwise distract a young child. For example, a flexible-type of display screen may be used to play videos, show photos, or play music. Such a device may also incorporate a voice activation feature to interact or distract a young child.

It should be appreciated that the electronic mechanism may include a variety of electronic components. For example, these may include components that communication over a network. The network may be a wireless network, a wired network or any combination of wireless network and wired network. For example, the network may include one or more of a fiber optics network, a passive optical network, a cable network, an Internet network, a satellite network (e.g., operating in Band C, Band Ku or Band Ka), a wireless LAN, a Global System for Mobile Communication ("GSM"), a Personal Communication Service ("PCS"), a Personal Area Network ("PAN"), D-AMPS, Wi-Fi, Fixed Wireless Data, IEEE 802.11a, 802.11b, 802.15.1, 802.11n and 802.11g or any other wired or wireless network for transmitting or receiving a data signal. In addition, the network may include, without limitation, telephone line, fiber optics, IEEE Ethernet 802.3, a wide area network ("WAN"), a local area network ("LAN"), or a global network such as the Internet. Also, the network may support, an Internet network, a wireless communication network, a cellular network, or the like, or any combination thereof. The network may further include one, or any number of the exemplary types of networks mentioned above operating as a stand-alone network or in cooperation with each other. The network may utilize one or more protocols of one or more network elements to which it is communicatively coupled. The network may translate to or from other protocols to one or more protocols of network devices. Although the network may be one network, it should be appreciated that according to one or more embodiments, the network may comprise a plurality of interconnected networks, such as, for example, a service provider network, the Internet, a broadcaster's network, a cable television network, corporate networks, or home networks.

The network components may transmit and receive data to and from the network representing a variety of content or other data. The electronic device, for example, may include a variety of wireless devices. These may include, but are not limited to, a mobile communications device, wireline phone, a cellular phone, a mobile phone, a satellite phone, a personal digital assistant ("PDA"), a computer, a handheld MP3 player, a handheld multimedia device, a personal media player, a gaming device, or other devices capable of communicating over a network.

In other embodiments, the one or more playthings 104 may include a bubble-blowing component. For example, the plaything 104 may include a bubble reservoir and a bubble stick for blowing bubbles. It should be appreciated that such a bubble-blowing component may be incorporated with an electronic mechanism so that bubbles may be created automatically by the one or more plaything 104. Other features, such as rate of bubble creation, size of bubbles, etc., may also be adjustable in the electronic component.

In other embodiments, the one or more playthings 104 may include an aromatic component. For example, the plaything 104 may include a material that is laced with fragrances or other non-toxic child-safe chemical. It should be appreciated that such an aromatic component may be incorporated with an electronic mechanism so that one or more fragrances or non-toxic, child-safe chemicals may be automatically released by the one or more plaything 104. Other features, such as rate of release or manual release valves, etc., may also be adjustable in the electronic component.

It should also be appreciated that a variety of non-toxic chemicals may be used. For example, these may include a chemical to help calm a child, help promote/induce sleep, and/or stimulate a child's appetite. For example, melatonin may calm a child and aid in regulating circadian rhythm to help with sleep. Some other natural sleep-inducing amino acids that contribute to a feeling of calmness may include Taurine, Tryptophan (a precursor of the sleep-inducing substances serotonin and melatonin), and/or GABA (Gamma Amino-Butyric Acid). These chemicals may have a calming effect on children. Calcium may also help a child's brain use the tryptophan to manufacture melatonin and is helpful in inducing sleep and relaxing the baby. Other safe chemicals may be derived from herbs. These may include passion flower extract (*Passiflora incarnata*), red clover, magnolia extract (*Magnolia officinalis*), bacopa, and/or Ashwagandha (*Withania somnifera*), also called Indian ginseng, etc. Scents from chamomile, lavender oil, Valarian root, and/or ground cinnamon bark may also be used for their soothing properties. Peppermint, lemon balms, St. John's Wort, kava kava and hops, ginseng and catnip may be other herbs that have sedative properties useful for relaxing and calming a child. Skullcap (*Scutellaria lateriflora*) may also be used since it is a relaxing nerve tonic with an excellent calming effect, especially suitable for sensitive toddlers.

Some of the above non-toxic chemicals may also help in trigger an increased appetite and help make eating more enjoyable by first relaxing the child and calming him. Other natural appetite boosters, e.g., vitamins-based and/or herbs, may include the B-Complex vitamins, zinc, niacin, thiamin, and catnip, fennel seed, ginger root, ginseng, gotu kola, papaya, parsley, fenugreek (*Trigonella foenum-graecum*), peppermint, spearmint, and/or Ashwagandha (*Withania somnifera*), also called Indian ginseng. Other scents may arouse a baby's appetite, such as breast milk, various fruit flavors (e.g., grape and orange flavors), citrus oils, bergamot and/or other essential oils.

It should be appreciated that the one or more playthings 104 may include a variety of objects that are capable of interacting or distracting a young child. The one or more playthings 104 may engage one or more senses of a young child. For example, these may include vision, audio, smell, touch, taste, or a combination thereof. A plaything 104 having a hologram or holographic mirror may appeal to both the visual sense and the touch sense. A plaything 104 having a spray for emitting child-safe fragrances may appeal to the smell sense and the touch sense.

Materials to form the one or more playthings 104 may include materials of any color, size, density, touch, weight, or appearance that is safe and may be interesting to a child. Some materials may be capable of changing colors, either chemically (e.g., temperature-dependent materials), electronically, or other color-changing mechanisms. It should be appreciated that the one or more playthings 104 should not be limited to the embodiments and examples described above. Other various embodiments may also be provided.

It should be appreciated that in some embodiments, the man portion 102 may be similar to the one or more playthings 104. For example, the main portion 102 may be a stuffed animal, plastic chew toys, child-safe mirrors, rattle, noisemaker, electronic mechanism, or other similar object.

The one or more attachment mechanisms 106 may include any of a number of attachment mechanisms 106 that permit the one or more playthings 104 to be, or prevent the one or more playthings 104 from being, detached from the main portion 102 by a child. In some embodiments, the one or more playthings 104 may be attached in a manner that permits a child to detach the one or more playthings 104 so that the child may manipulate the plaything independently of the main portion 102. For example, the one or more attachment mechanisms 106 may be provided to further the child's development. These may include, but not limited to, a hook and loop system, a button, a zipper, a string, Velcro, elastic cord (e.g., zip line), or other attachment mechanism. Each of these attachment mechanism types may teach and educate a child, in addition to providing a fun activity. The one or more playthings 104 may also be attached to the main portion 102 in a manner that prevents the child from detaching the plaything from the main portion 102. Here the child may be permitted to only manipulate the plaything 104 while it is still attached to the main portion 102. Other attachment mechanisms 106 may also include thread, string, magnets, and or other special technology to give the one or more attachment mechanisms 106 low visibility. It should be appreciated that the one or more attachment mechanisms 106 may be attachable/detachable along any portion of the one or more attachment mechanisms 106. For instance, a stringed attachment mechanism may be attachable/detachable at either end of the string, anywhere along the string, or a combination thereof.

Figure 2:
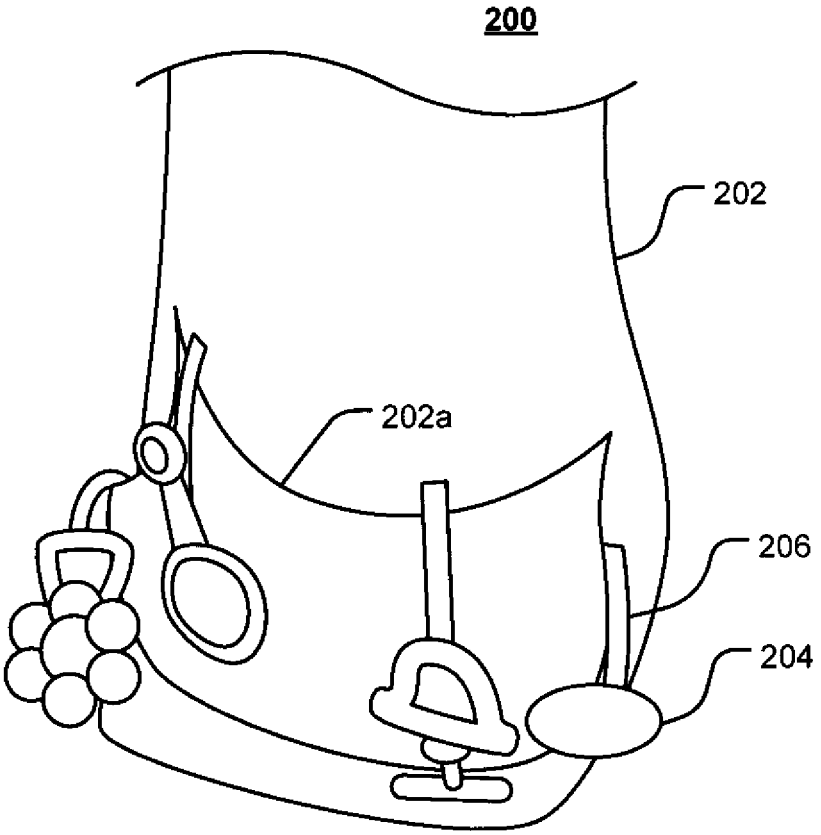
FIG. 2 depicts an illustrative child activity device, according to another exemplary embodiment.

FIG. 2 depicts an illustrative child activity device 200, according to an exemplary embodiment. The child activity device 200 may include a main portion 202 and one or more playthings 204. The one or more playthings 204 may be attachable or detachable to the main portion 202 using one or more attachment mechanisms 206. In some embodiments, the main portion may include a pocket 202a or other similar feature.

In some embodiments, the main portion 202 may be worn around a torso of a child or a caregiver. For example, the main portion 202 may be an apron, a shirt, a jacket, a vest, or a belt. It should also be appreciated that the main portion 202 may also be attached to other objects, such as a dresser, walls, a door, a crib, or other object.

The main portion 202 may be adjustable so that the main portion 202 may fit on objects of various sizes (e.g., bodies of different people). Accordingly, the main portion 202 may be fitted, adjustable, or a "one-size-fits-all" size. The main portion 202 may also have one or more securement mechanisms to provide greater security of the child activity device 100 to an object to which it is attached (e.g., torso). These may include laces, straps, Velcro, buttons, zippers, or other securement mechanisms.

In an exemplary embodiment, the child activity device 200 may be worn on a caregiver's body and may be particularly suited to experiences where the caregiver is facing the child, such as when the caregiver is feeding, bathing and/or interacting with the child.

It should be appreciated that the one or more playthings 204 and one or more attachment mechanisms 206 of the child activity device 200, as depicted in FIG. 2, may be similar to the one or more playthings 104 and one or more attachment mechanisms 106 of the child activity device 100 of FIG. 1, as described above.

Figure 3:
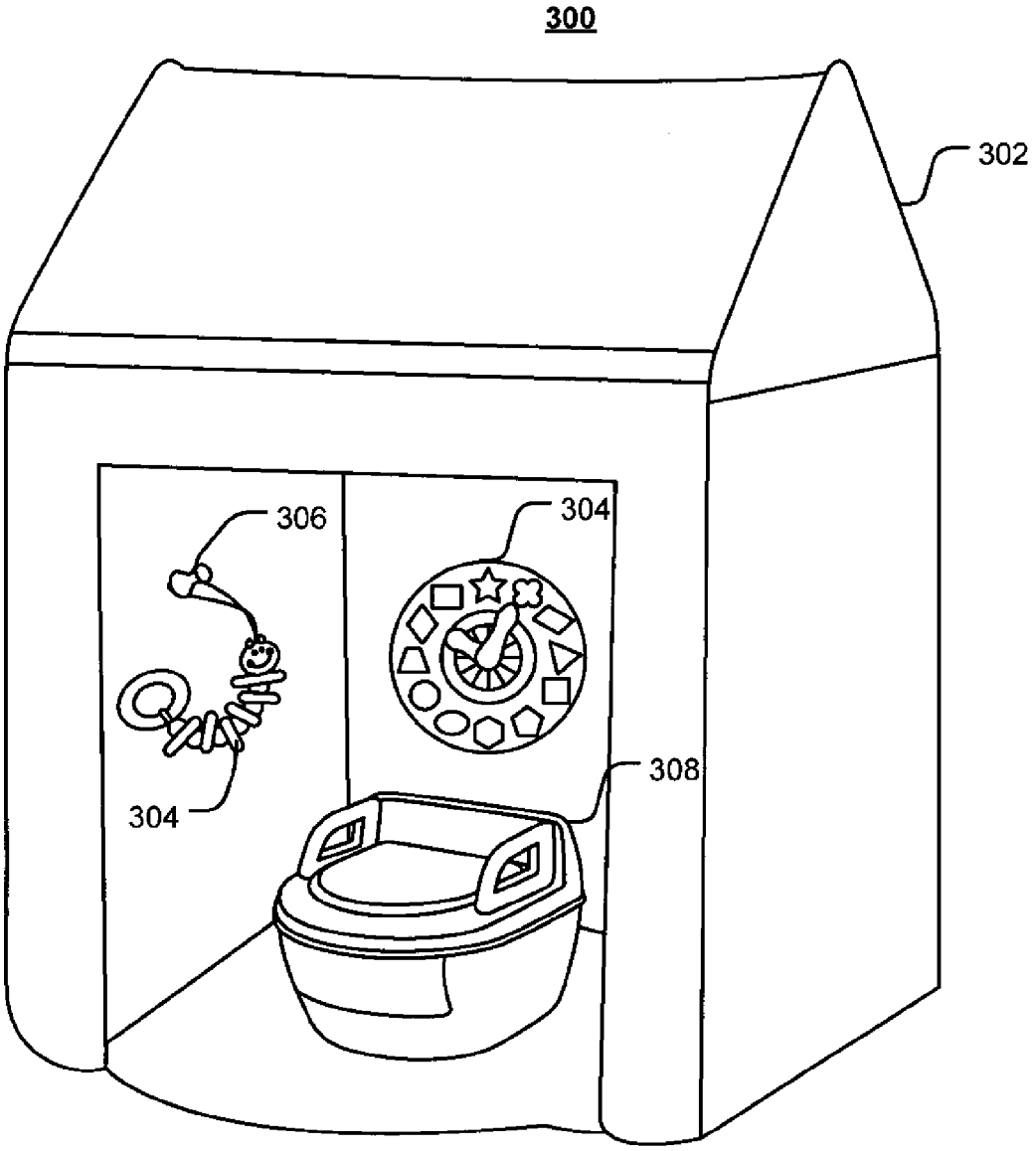
FIG. 3 depicts an illustrative child activity device, according to yet another exemplary embodiment.

FIG. 3 depicts an illustrative child activity device 300, according to an exemplary embodiment. The child activity device 300 may include a main portion 302 and one or more playthings 304. The one or more playthings 304 may be attachable or detachable to the main portion 302 using one or more attachment mechanisms 306.

In some embodiments, the main portion 302 may be a stand-alone structure. In other words, the main portion 302 may not be required to be worn by a caregiver. The stand-alone structure may be a tent-like structure or other structure, such as a wallpiece, a stroller, a stroller attachment, a crib, a crib attachment, a carseat, or a carseat attachment. It should also be appreciated that the child activity device 300 may also include other structures 308, such as a potty, chair, pillow, mat, table, blanket, stroller, crib, carseat, or other ancillary structure. This additional structure 308 may be position inside, near, or around the main portion 302. In some embodiments, this additional structure 308 may also include one or more playthings (not shown) attached to the structure 308 through one or more attachment mechanisms, similar to those described above.

The main portion 302 may be adjustable to fit in a variety of living spaces. The child activity device 300 may be particularly suited to experiences where a caregiver may not be in immediate proximity to a child. This way, a child may have some privacy as well as one or more playthings 104 with which to interact while sitting on a potty, for example.

It should be appreciated that the one or more playthings 304 and one or more attachment mechanisms 306 of the child activity device 300, as depicted in FIG. 3, may be similar to the one or more playthings 104 and one or more attachment mechanisms 106 of the child activity device 100 of FIG. 1, as described above.

It should be appreciated that in some embodiments, the main portion 302 may also be a foldable, expandable, or portable. For example, in some embodiments, the main portion may be another type of stand-alone structure. These may include a blanket, pillow, or other furniture-like structure.

It should also be appreciated the embodiments described with respect to one component of a child activity device may be implemented in another component of the child activity device. For example, the embodiments and examples described with respect to the one or more playthings may be implemented in the main portion, the one or more attachment mechanism, etc.

Figure 4:
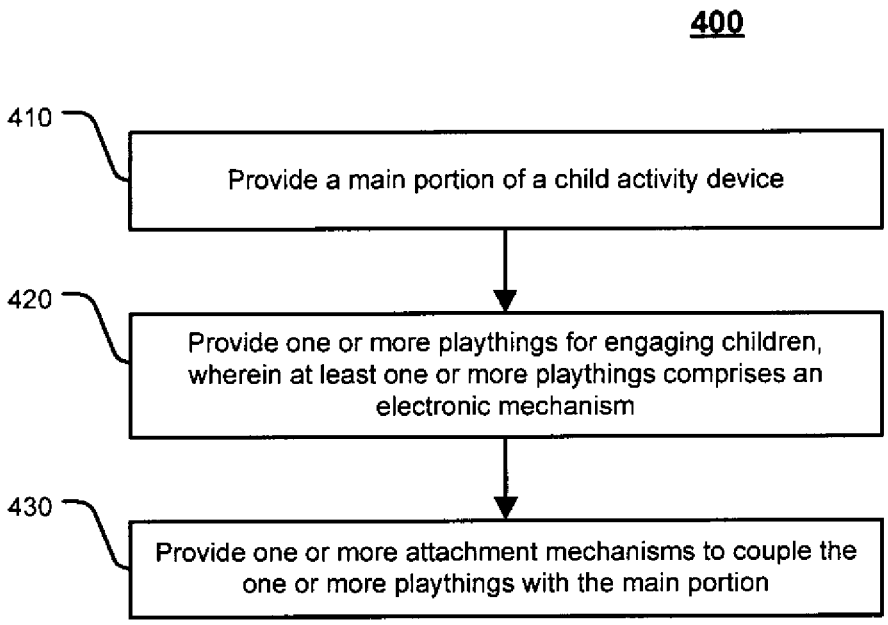
FIG. 4 depicts an illustrative flowchart of a method for providing a child activity device, according to an exemplary embodiment.

FIG. 4 depicts an illustrative flowchart of a method for engaging children, according to an exemplary embodiment. The exemplary method 400 is provided by way of example, as there are a variety of ways to carry out methods disclosed herein. The method 400 shown in FIG. 4 may be executed or otherwise performed by one or a combination of various systems. The method 400 is described below as carried out by at least device 100 in FIG. 1, device 200 n FIG. 2, and device 300 in FIG. 3, by way of example, and various elements of devices 100, 200, and 300 are referenced in explaining the exemplary method of FIG. 4. Each block shown in FIG. 4 represents one or more processes, methods, or subroutines carried in the exemplary method 400. A computer readable medium comprising code to perform the acts of the method 400 may also be provided. Referring to FIG. 4, the exemplary method 400 may begin at block 410

At block 410, a main portion of a child activity device may be provided. In some embodiments, the main portion may be a headpiece for being worn by a caregiver comprising at least one of a hat, a cap, a visor, a headband, a bonnet, or other headpiece. In some embodiments, the main portion may be a garment for being worn by a caregiver comprising at least one of an apron, a shirt, a jacket, a vest, a belt or other garment. In other embodiments, the main portion may be a stand-alone structure comprising a tent, a blanket, a pillow, a wallpiece, a stroller, a stroller attachment, a crib, a crib attachment, a carseat, a carseat attachment, or other structure. It should be appreciated that the stand-alone structure may be foldable, expandable, portable, or a combination thereof. It should also be appreciated that the main portion may be configured to accompany an ancillary component, wherein the ancillary component is positioned inside, near, or around the main portion. Here, the ancillary component may be a potty, a chair, a table, a blanket, a pillow, a mat, a stroller, a crib, a carseat, or other ancillary component or structure.

At block 420, one or more playthings for engaging children may be provided. In some embodiments, the one or more playthings may be a stuffed animal, plastic chew toys, child-safe mirrors, rattle, noisemaker, or combination thereof. Other various playthings or items may also be provided. In some embodiments, the one or more playthings may incorporate an electronic mechanism that produces at least one of a light, noise, and movement.

At block 430, one or more attachment mechanisms to couple the one or more playthings with the main portion may be provided. In some embodiments, the one or more attachment mechanisms may be a hook and loop system, a button, a zipper, a string, Velcro fastener, non-removable attachment mechanism, or combination thereof. Other various attachment mechanisms may also be provided.

Although the embodiments of the present invention has been described herein in the context of a particular implementation in a particular environment for a particular purpose, those of ordinary skill in the art will recognize that its usefulness may not be limited thereto and that the embodiments of the present invention may be beneficially implemented in any number of environments for any number of purposes. It should also be appreciated that exemplary embodiments may be susceptible to broad utility and application.

For example, it should be appreciated that while embodiments are directed to children, other various implementations may also be provided. For instance, exemplary embodiments may also be provided for engaging adults or animals.

In the preceding specification, various embodiments have been described with reference to the accompanying drawings. It will, however, be evident that various modifications and changes may be made thereto, and additional embodiments may be implemented, without departing from the broader scope of the disclosure as set forth in the claims that follow. The specification and drawings are accordingly to be regarded in an illustrative rather than restrictive sense.

The invention claimed is:

1. A child activity device, comprising:

a main portion, wherein the main portion is capable of being worn by a caregiver;

a plurality of playthings for engaging a child, wherein at least one of the plurality of playthings comprises an electronic mechanism and at least another one of the plurality of playthings comprises one or more of stuffed animal, children's plastic chew toy, child-safe mirror and baby rattle and wherein each of the plurality of playthings is attached to a lower portion of the main portion to enable each of the plurality of playthings to hang from the main portion so that the plurality of playthings hang below the lower portion of the main portion and engage the child; and one or more attachment mechanisms to couple the one or more playthings with the lower portion of the main portion, wherein the one or more attachment mechanisms are easily removably attachable.

2. The child activity device of claim 1, wherein the main portion is a headpiece comprising at least one of a hat, a cap, a visor, a headband, or a bonnet.

3. The child activity device of claim 1, wherein the one or more playthings further comprises a motorized flying object.

4. The child activity device of claim 1, wherein the electronic mechanism produces at least one of a light, noise, non-toxic chemical, and movement.

5. The child activity device of claim 1, wherein the one or more attachment mechanisms is a hook and loop system, a button, a zipper, a string, Velcro fastener, non-removable attachment mechanism, zip line, magnet, or combination thereof.

* * * * *